US010561240B1

(12) United States Patent
Kao

(10) Patent No.: US 10,561,240 B1
(45) Date of Patent: Feb. 18, 2020

(54) DRAWER SLIDE WITH A TWO-WAY OPENING AND CLOSING

(71) Applicant: SUN CHAIN METAL INDUSTRY CO., LTD., Taipei (TW)

(72) Inventor: Pei-Ssu Kao, Taipei (TW)

(73) Assignee: SUN CHAIN METAL INDUSTRY CO., LTD., Taipei (TW)

( * ) Notice: Subject to any disclaimer, the term of this patent is extended or adjusted under 35 U.S.C. 154(b) by 0 days.

(21) Appl. No.: 16/352,821

(22) Filed: Mar. 14, 2019

(51) Int. Cl.
*A47B 88/00* (2017.01)
*A47B 88/473* (2017.01)

(52) U.S. Cl.
CPC .... *A47B 88/473* (2017.01); *A47B 2210/0018* (2013.01)

(58) Field of Classification Search
CPC ..... A47B 88/473; A47B 2210/0018; A47B 88/423; A47B 88/407; A47B 88/44; A47B 88/443; A47B 88/447; A47B 88/49; A47B 88/493; A47B 2210/0016; A47B 2210/0059; A47B 2210/0081
USPC ..... 312/333, 334.44–334.47, 334.1, 334.7, 312/334.8
See application file for complete search history.

(56) References Cited

U.S. PATENT DOCUMENTS 5,033,805 A * 7/1991 Hobbs ..... A47B 88/493 312/333
7,029,080 B2 * 4/2006 Barry, Jr. ..... H05K 7/1489 312/333
7,101,081 B2 * 9/2006 Chen ..... A47B 88/493 312/334.46
7,240,977 B2 * 7/2007 He ..... H05K 7/1489 312/333
7,611,213 B2 * 11/2009 Wu ..... A47B 88/493 292/80
8,282,176 B1 * 10/2012 Chen ..... A47B 88/493 312/333
8,496,306 B2 * 7/2013 Chen ..... A47B 88/463 312/319.1
8,500,223 B2 * 8/2013 Lacarra ..... A47B 88/57 312/334.45
10,362,870 B1 * 7/2019 Smith
2003/0209958 A1 * 11/2003 Hwang ..... A47B 88/49 312/334.46

(Continued)

FOREIGN PATENT DOCUMENTS

EP 3041328 * 7/2016

*Primary Examiner* — Janet M Wilkens
(74) *Attorney, Agent, or Firm* — Bruce Stone LLP; Joseph A. Bruce

(57) ABSTRACT

A drawer slide with a two-way opening and closing structure includes: a main rail, a pivot block pivotally provided on the main rail, a slide rail slidably mounted on the main rail, and a pull lever pivotally disposed on the slide rail. The main rail has a limiting portion disposed along a vertical direction. The pivot block has an offset post movably disposed at the limiting portion along the vertical direction, and a first dislocation block which can be locked with a second dislocation block of the pull lever in a staggered manner. The user can set two sets of identical drawer slides with the two-way opening and closing structure on two sides of the drawer, and the first and second dislocation blocks can be misaligned by the limiting portion, namely, two identical slide rails 40 can be applied to the two opposite sides of the drawer.

15 Claims, 11 Drawing Sheets

(56) References Cited

U.S. PATENT DOCUMENTS

| | | | | |
|---|---|---|---|---|
| 2004/0056572 | A1* | 3/2004 | Chen | E05C 3/14 312/333 |
| 2008/0278048 | A1* | 11/2008 | Burgess | A47B 88/49 312/333 |
| 2008/0303399 | A1* | 12/2008 | Huang | A47B 88/49 312/334.46 |
| 2009/0058241 | A1* | 3/2009 | Huang | A47B 88/49 312/334.8 |
| 2009/0195133 | A1* | 8/2009 | Chang | A47B 88/493 312/334.46 |
| 2010/0039009 | A1* | 2/2010 | Chen | A47B 88/423 312/334.2 |
| 2011/0291539 | A1* | 12/2011 | Leal | A47B 88/493 312/334.44 |
| 2012/0043872 | A1* | 2/2012 | Enos | A47B 88/493 312/332.1 |
| 2016/0060934 | A1* | 3/2016 | Chen | A47B 88/44 16/96 R |

* cited by examiner

DRAWER SLIDE WITH A TWO-WAY OPENING AND CLOSING

BACKGROUND

Field of the Invention

The present invention relates to a drawer slide, and more particularly to a drawer slide with a two-way opening and closing structure.

Related Prior Art

Referring to FIGS. 1 and 2, in order to prevent the drawer from being opened when it is not necessary to open, there is a locking slide on the market, and the main structure thereof comprises: a main rail 11 and a slide rail 12 which can be slidably disposed in the main rail 11, and a locking device 13 disposed on the slide rail 12. The main rail 11 is mounted on a cabinet, a locking slot 111 is formed at one end of the main rail 11, and the main rail 11 is provided with a locking protrusion 112 protrudes towards the locking slot 111. One end of the locking protrusion 112 forms a gap 113 with respect to the inner surface of the main rail 11. The locking device 13 has a lever 131 pivotally mounted on the slide rail 12, an elastic member 132 disposed on the lever 131, and a positioning protrusion 133 protruded from the lever 131.

In use, when the slide rail 12 is completely withdrawn into the main rail 11, the positioning protrusion 133 moves into the locking slot 111, and the elastic member 132 pushes the lever 131 to move towards one side of the slide rail 12 until the positioning protrusion 133 abuts against the locking protrusion 112, thereby preventing the slide rail 12 from sliding on the main rail 11.

When the user wants to pull out the drawer, he/she only needs to move the positioning protrusion 133 away from the locking protrusion 112 to the gap 113 by pulling the lever 131, and when the positioning protrusion 133 disengages from the locking slot 111 via the gap 113, the slide rail 12 will be free to slide on the main rail 11.

The drawer is generally provided at both sides thereof with such slide rails 12, and a gripping rod is disposed between the two levers 131, so that the user can pull out the drawer by pulling the gripping rod.

However, the two slide rails 12 mounted on the two sides of the drawer are symmetrical to each other but not exactly the same. The manufacturer has to produce two different types of slide rails 12 to be mounted on the left and right sides of the drawer. This will not only cause storage difficulties, but also the slide rails 12 are likely to be installed in wrong directions when they are being installed on the cabinet. Besides, it is also necessary to use two different types of molds to produce the two different symmetrical slide rails, resulting in a high cost.

The present invention has arisen to mitigate and/or obviate the afore-described disadvantages.

SUMMARY

The first objective of the present invention is to solve the problem that the slide rails of two different directions must be stored, so that the same slide rail can be applied to the opposite sides of the drawer.

The second objective of the present invention is to solve the problem that the slide rails are likely to be in the wrong direction when being installed on the drawer, thereby making it easier to install the slide rails.

The third objective of the invention is to solve the defect that two types of modules are required for manufacturing of symmetrical slide rails, thereby reducing the overall manufacturing cost.

To achieve the above objectives, a drawer slide with a two-way opening and closing structure, in accordance with the present invention comprises:

a main rail having a limiting portion disposed along a vertical direction and a sliding end at one end of the main rail;

a pivot block having an offset post, a first guide tip, a first connecting surface adjacent to the first guide tip, a second connecting surface adjacent to the first guide tip, and a first stop surface;

a slide rail having two opposing side walls;

a pull lever having two opposite side surfaces, a second guide tip, a first guide surface adjacent to the second guide tip, a second guide surface adjacent to the first guide tip, and a second stop surface;

at least one elastic member;

wherein the pivot block is pivotally disposed on the main rail, the offset post is movably disposed at the limiting portion along the vertical direction, the first guide tip is located toward the end, the first stop surface is located away from the end, the slide rail is slidably disposed on the main rail along the displacement direction, the pull lever is pivotally provided on the slide rail and disposed between the two side walls, so that the two side surfaces face and are located a distance from the side walls, the at least one elastic member is disposed between the two side walls and the two side surfaces;

by such arrangements, the slide rail has a slide-out state, a slide-in state, and a locked state;

when in the slide-out state, the offset post is abutted against one end of the limiting portion, so that the first and second guide tips are opposite to each other in a misaligned manner;

when in the slide-in state, the first connecting surface is in contact with the first guide surface, or the second connecting surface is in contact with the second guide surface;

when in the locked state, the first stop surface abuts against the second stop surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION

The present invention will be clearer from the following description when viewed together with the accompanying drawings, which show, for purpose of illustrations only, the preferred embodiment in accordance with the present invention.

Figure 1:
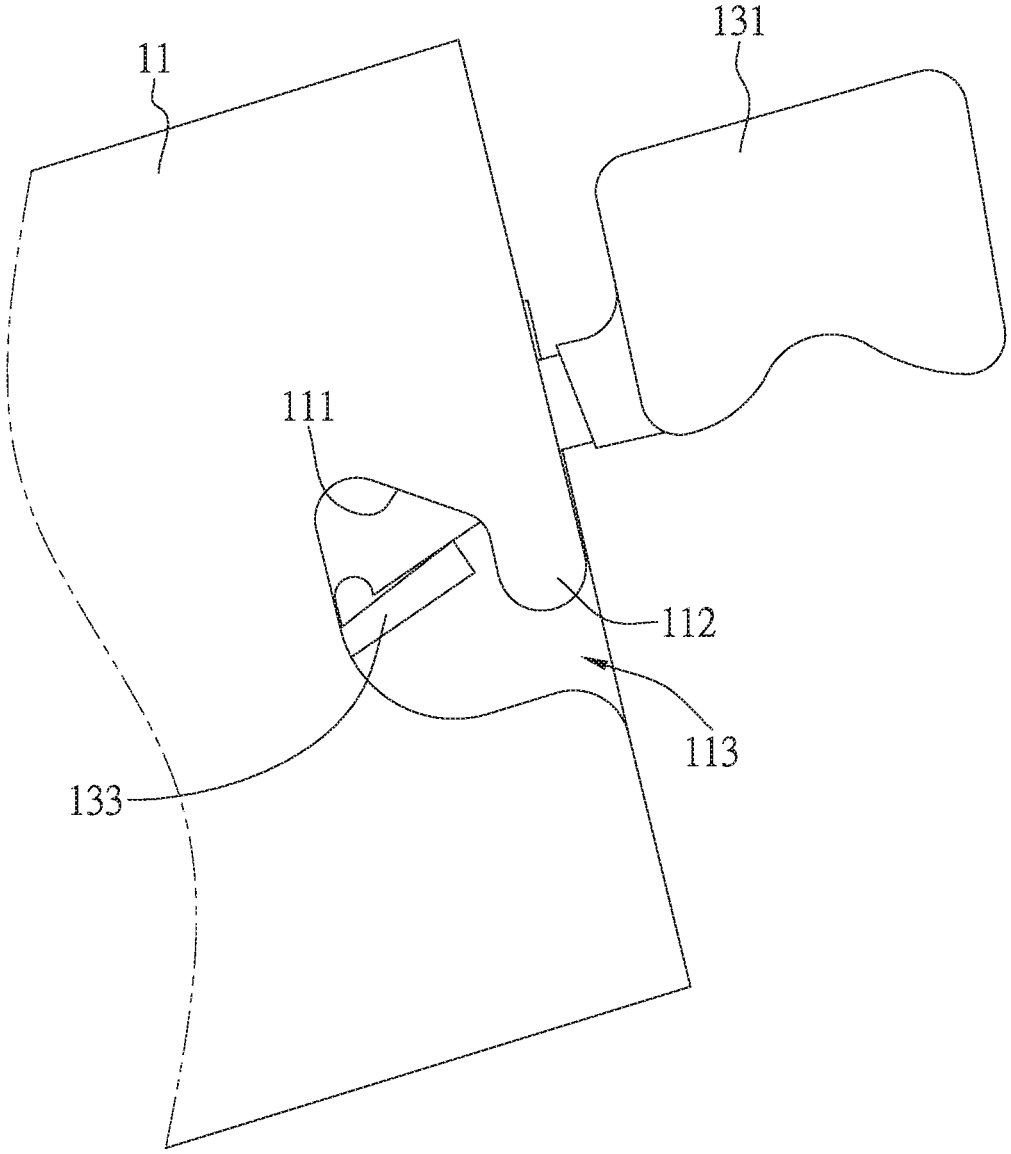
PRIOR ART FIG.1
FIG. 1 is a side view of a drawer slide with a conventional one-way opening and closing structure.
Figure 2:
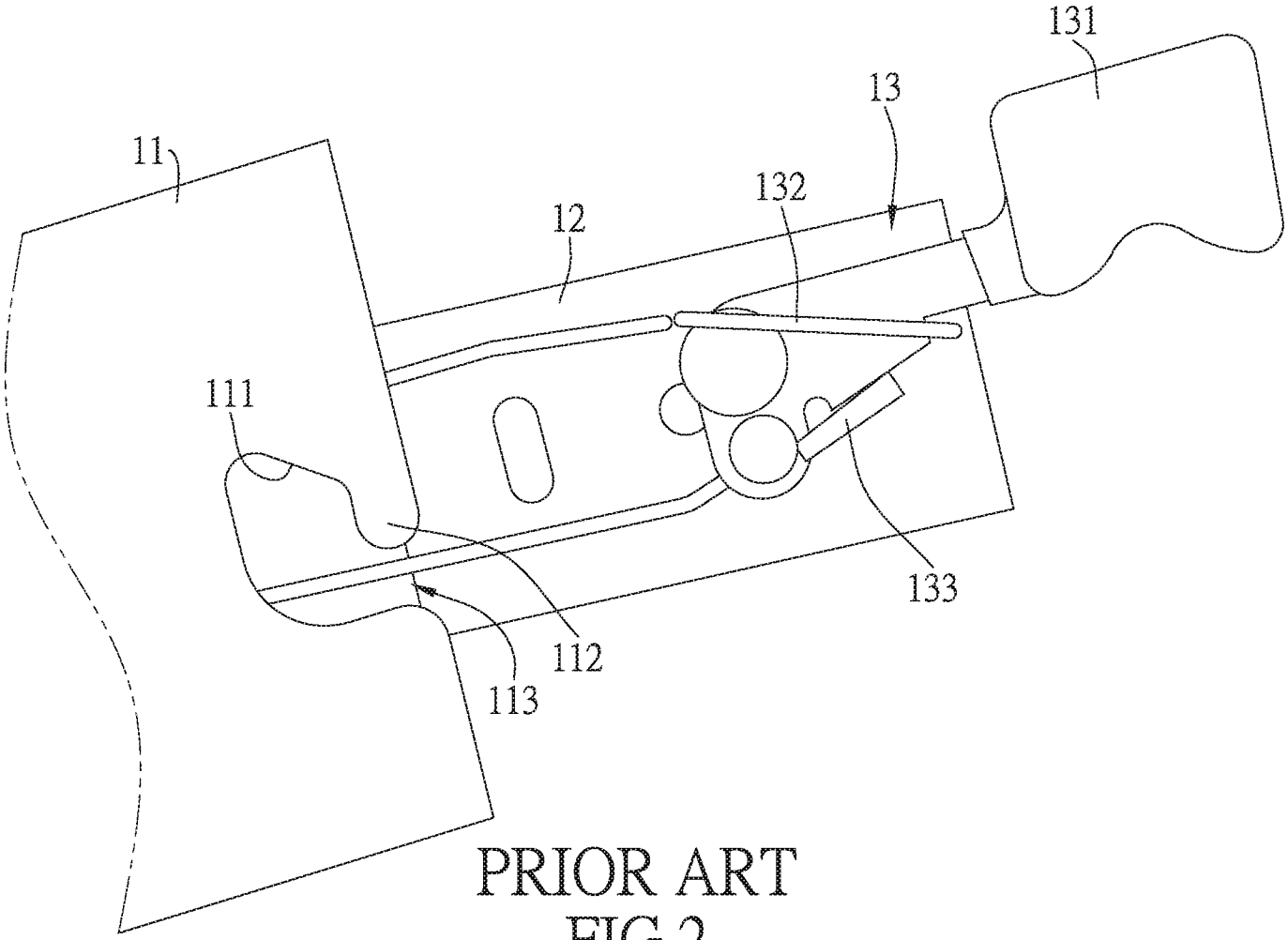
PRIOR ART FIG.2
FIG. 2 is a side elevational view of the drawer slide with the conventional one-way opening and closing structure.
Figure 3:
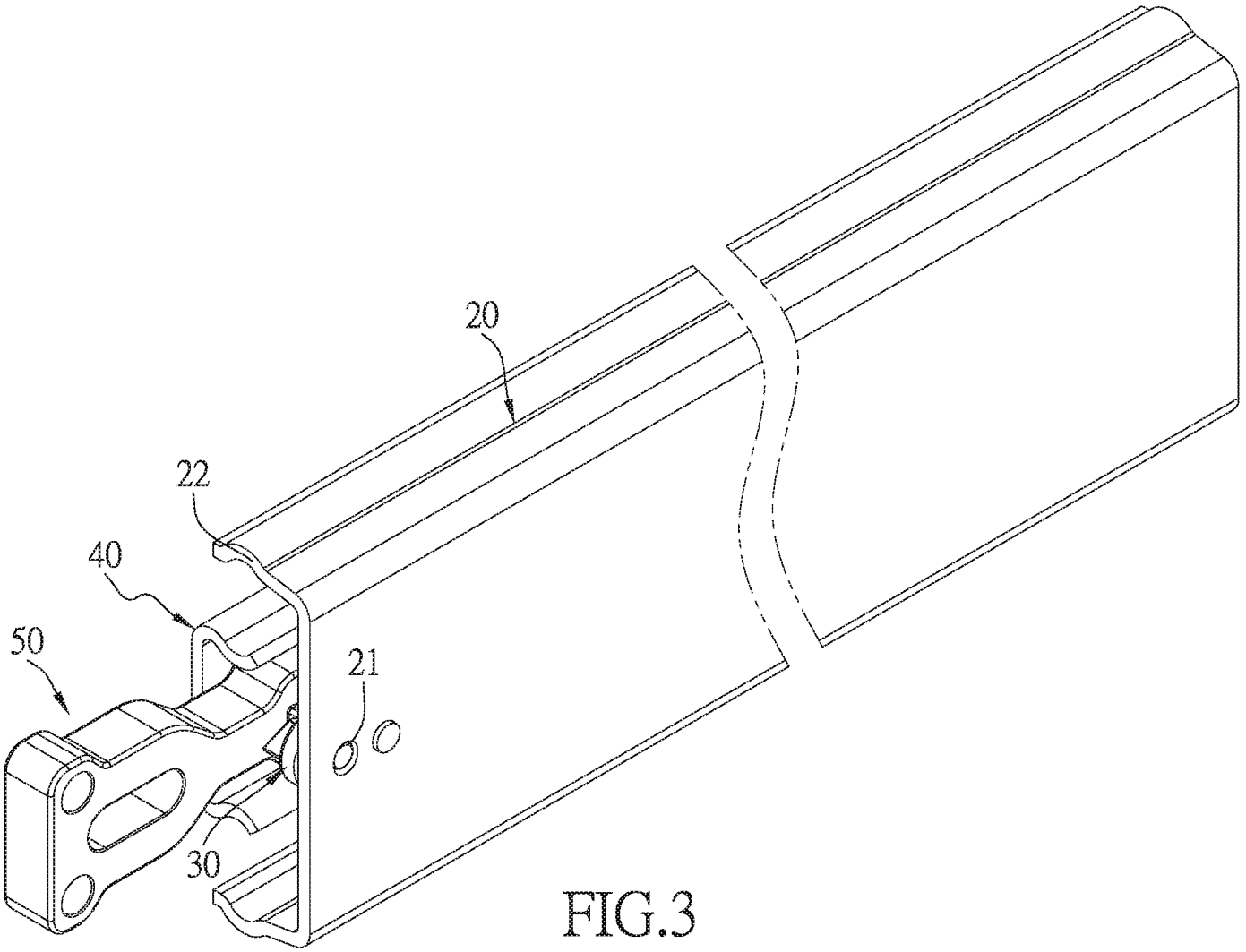
FIG. 3 is a perspective view of the present invention in a preferred embodiment.
Figure 4:
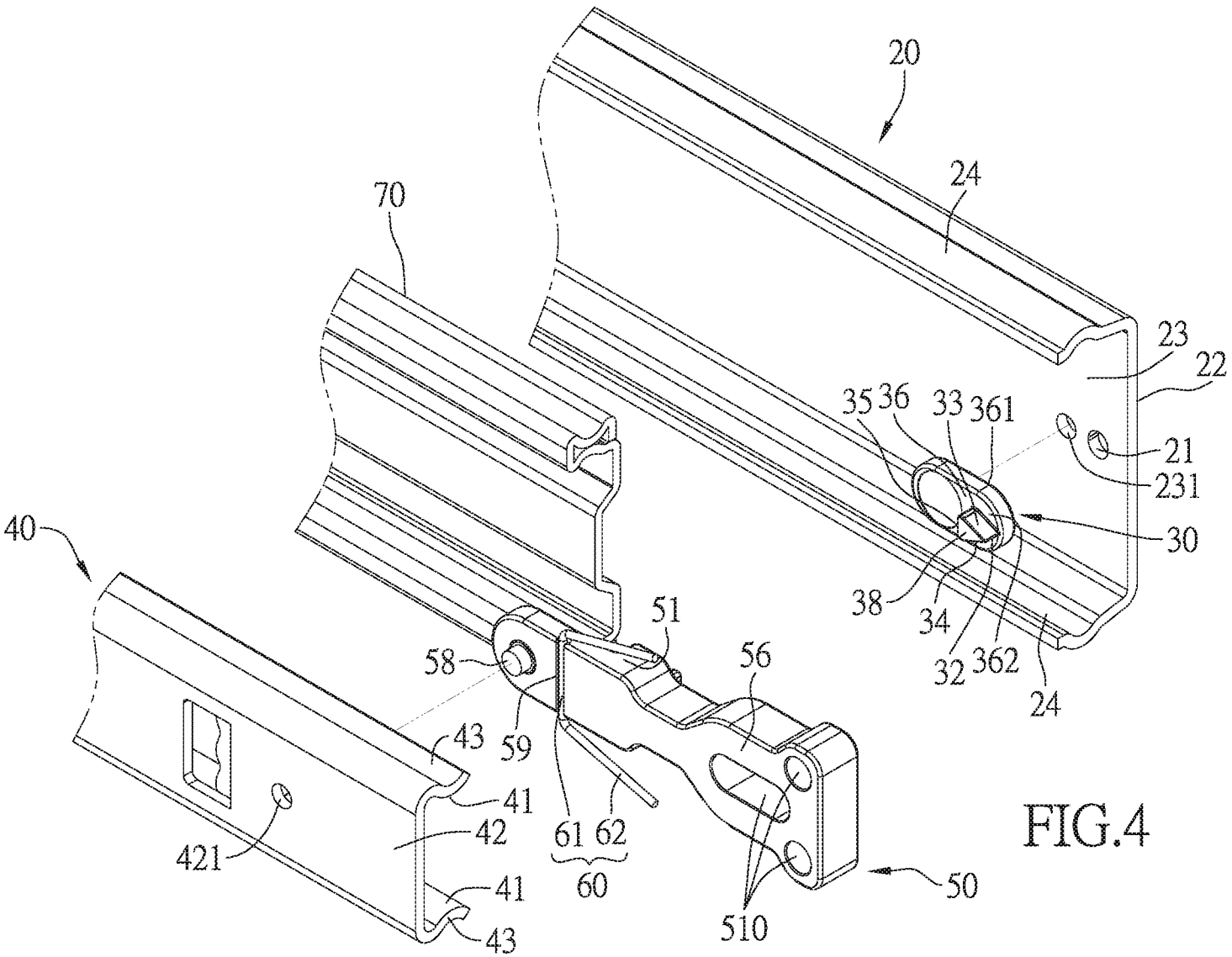
FIG. 4 is an exploded view of the present invention in a preferred embodiment.
Figure 5:
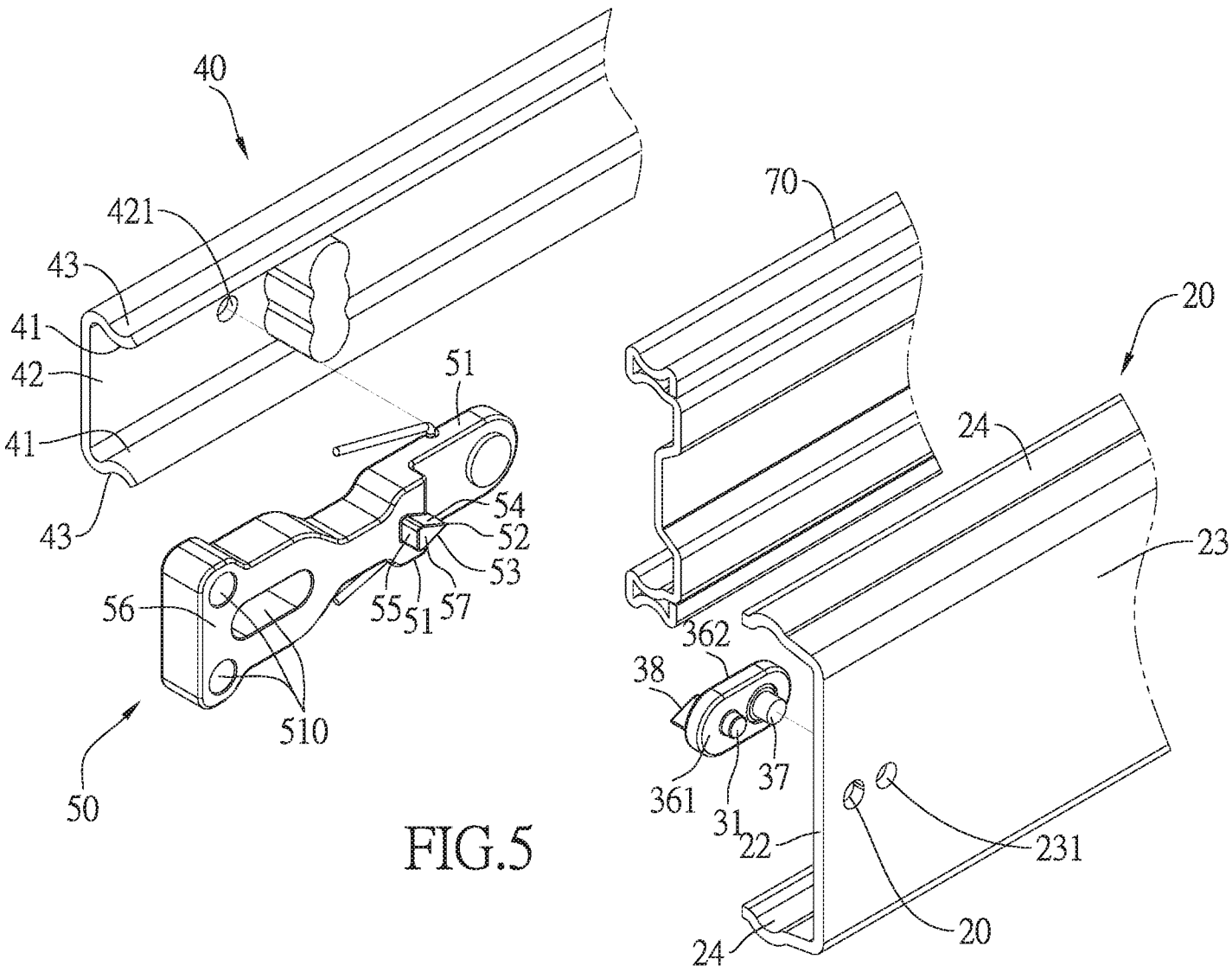
FIG. 5 is an exploded view of another orientation of the present invention in a preferred embodiment.

Referring to FIGS. 3-5, the present invention provides a drawer slide with a two-way opening and closing structure, comprising: a main rail 20, a pivot block 30, a slide rail 40, a pull lever 50, and at least one elastic member 60.

The main rail 20 has a limiting portion 21 disposed along a vertical direction Y and an end 22 at one end of the main rail 20. In this embodiment, the main rail 20 has a main rail base portion 23 extending along a displacement direction X, and two main rail side portions 24 disposed on two sides of the main rail base portion 23. The two main rail side portions 24 are opposite to each other in the vertical direction Y. The main rail base portion 23 of the main rail 20 is further provided with a main rail pivot hole 231. The limiting portion 21 is also formed on the main rail base portion 23 and is located closer to the end 22 than the main rail pivot hole 231.

The pivot block 30 has an offset post 31, a first guide tip 32, a first connecting surface 33 adjacent to the first guide tip 32, a second connecting surface 34 adjacent to the first guide tip 32, and a first stop surface 35. In this embodiment, the pivot block 30 has a pivot base portion 36, and the pivot base portion 36 has a first surface 361 and a second surface 362 opposite to each other. The first surface 361 is provided with a pivot post 37, and the offset post 31 is disposed on the first surface 361. The second surface 362 is provided with a first dislocation block 38, and the first guide tip 32, the first connecting surface 33, the second connecting surface 34, and the first stop surface 35 are located on the first dislocation block 38, in such a manner that the first and second connecting surfaces 33, 34 each have one end connected to the first guide tip 32, and have another end connected to two ends of the first stop surface 35, respectively, so that the first dislocation block 38 is generally triangular in shape.

The slide rail 40 has two opposing side walls 41. In this embodiment, the slide rail 40 has a slide rail base portion 42, and two slide rail side portions 43 which are disposed on two sides of the slide rail base portion 42 and are opposed to each other along the vertical direction Y. A slide rail pivot hole 421 is disposed on the slide base portion 42.

The pull lever 50 has two opposite side surfaces 51, a second guide tip 52, a first guide surface 53 adjacent to the second guide tip 52, a second guide surface 54 adjacent to the first guide tip 32, and a second stop surface 55. In this embodiment, the pull lever 50 has a lever body 56, and the two side surfaces 51 are located on two sides of the lever body 56. A second dislocation block 57 is protruded from one surface of the lever body 56, and another opposite surface of the lever body 56 is provided with a lever pivot post 58 and an engaging groove 59. The second guide tip 52, the first guide surface 53, the second guide surface 54 and the second stop surface 55 are located on the second dislocation block 57. The first and second guide surfaces 53, 54 each have one end connected to the second guide tip 52, and have another end connected to the second stop surface 55, so that the second dislocation block 57 is triangular in shape.

In this embodiment, the at least one elastic member 60 has a fixing arm 61 and two elastic arms 62 respectively connected two ends of the fixing arm 61.

The pivot block 30 is pivotally disposed on the main rail 20, and the offset post 31 is movably disposed at the limiting portion 21 along the vertical direction Y. The first guide tip 32 is located toward the end 22, and the first stop surface 35 is located away from the end 22. The slide rail 40 is slidably disposed on the main rail 20 along the displacement direction X. The pull lever 50 is pivotally provided on the slide rail 40 and disposed between the two side walls 41, in such a manner that the two side surfaces 51 face and are located a distance M from the side walls 41. The at least one elastic member 60 is disposed between the two side walls 41 and the two side surfaces 51.

In this embodiment, the pivot post 37 of the pivot block 30 is pivotally disposed in the main rail pivot hole 231, so that the pivot block 30 can pivot about the main rail pivot hole 231. The offset post 31 is disposed in the limiting portion 21 and movable along the vertical direction Y.

The lever pivot post 58 of the pull lever 50 is pivotally disposed in the slide rail pivot hole 421 of the slide rail, so that the pull lever 50 can pivot about the slide rail pivot hole 421. The fixing arm 61 of the elastic member 60 is engaged in the engaging groove 59, and the two elastic arms 62 respectively protrude from the two side surfaces 51, and each have one end pushed against the slide rail side portions 43, so that the pull lever 50 is positioned in the middle between the two slide rail side portions 43.

Preferably, an extension rail 70 is disposed between the main rail 20 and the slide rail 40, and the main rail 20 is coupled to the slide rail 40 along the displacement direction X through the extension rail 70, so that the total length is extended when the main rail 20, the extension rail 70 and the slide rail 40 all slide out.

The above description is the configuration description of each main component of the embodiment of the present invention. The effects and functions of the present invention are explained below.

The slide rail 40 can slide along the displacement direction X in the main rail 20, so that the slide rail 40 has a slide-out state, a slide-in state, and a locked state.

Figure 6:
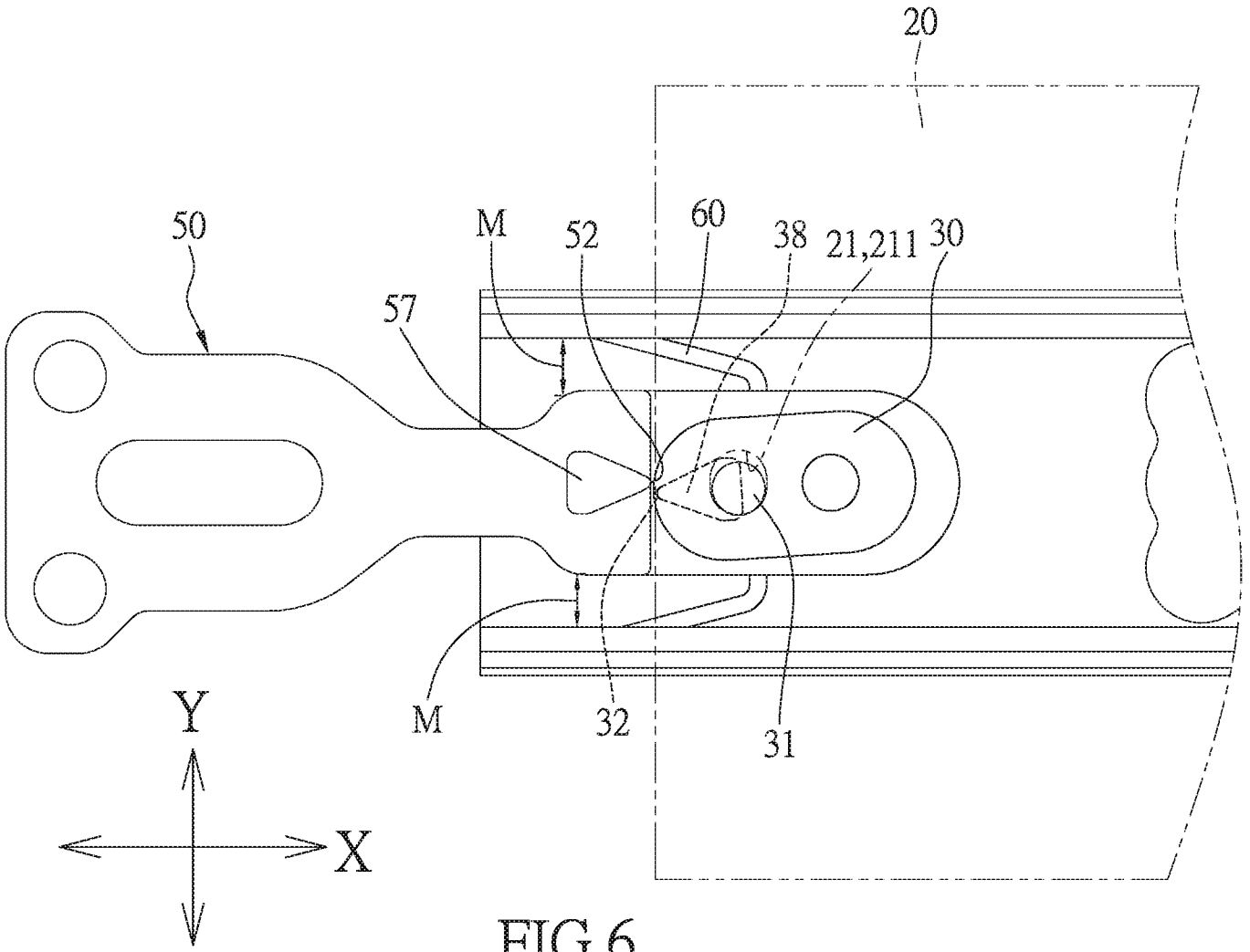
FIG. 6 is a side elevational view of the present invention in a slide-out state in a preferred embodiment.

Referring to FIG. 6, when in the slide-out state, since the pivot block 30 is pivotally mounted on the main rail 20, the offset post 31 is abutted against one end of the limiting portion 21 close to the ground because of gravity, so that the first and second guide tips 32, 52 are opposite to each other in a misaligned manner.

Figure 7:
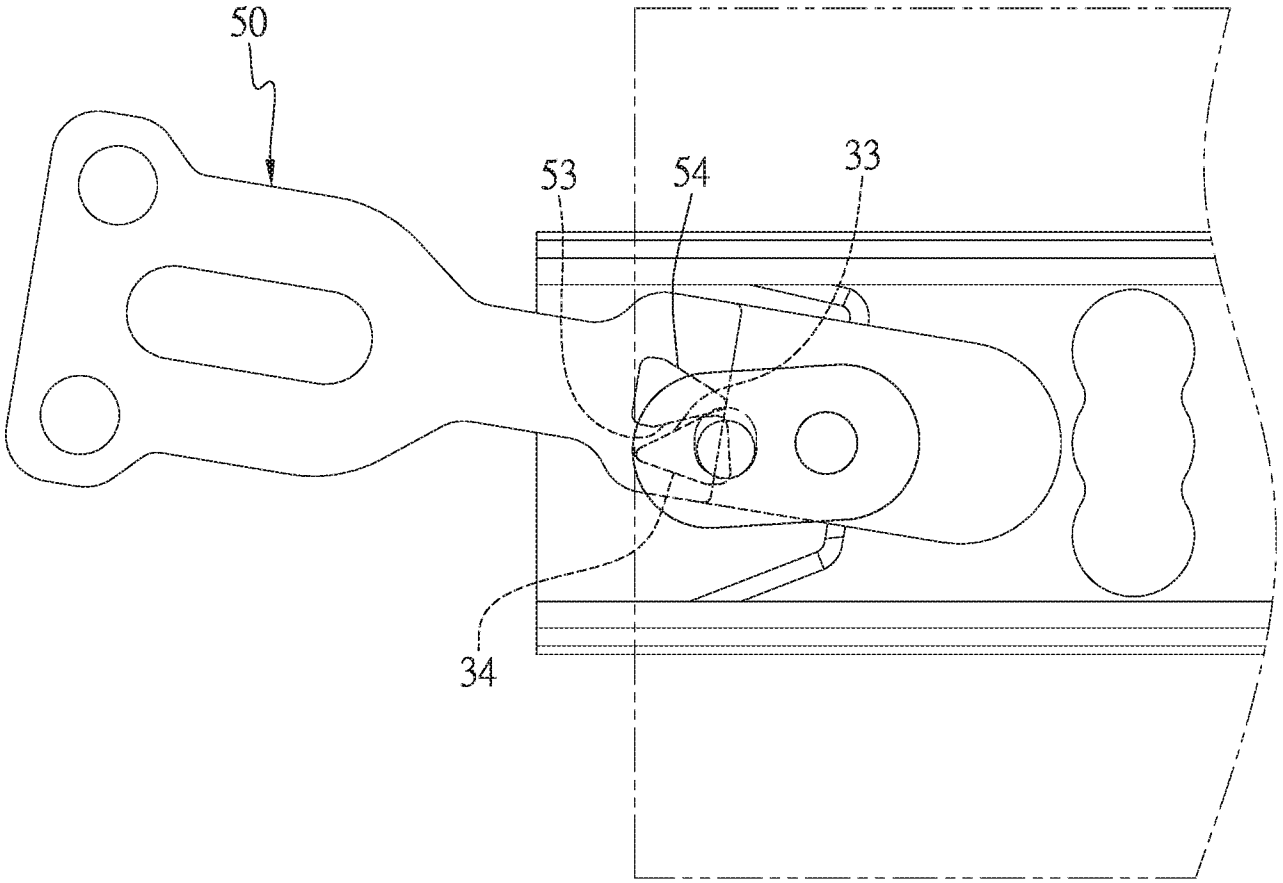
FIG. 7 is a side elevational view of the present invention in a slide-in state in a preferred embodiment.

Referring to FIG. 7, when in the slide-in state, the slide rail 40 is pushed along the displacement direction X, since the first and second guide tips 32, 52 are staggered or misaligned to each other, the first connecting surface 33 is in contact with the first guide surface 53 or the second connecting surface 34 is in contact with the second guide surface 54. Since the second dislocation block 57 of the pull lever 50 is pulled by the first dislocation block 38, the pull lever 50 is pivoted about the slide rail pivot hole 421 and shifted toward one of the slide rail side portions 43.

Figure 8:
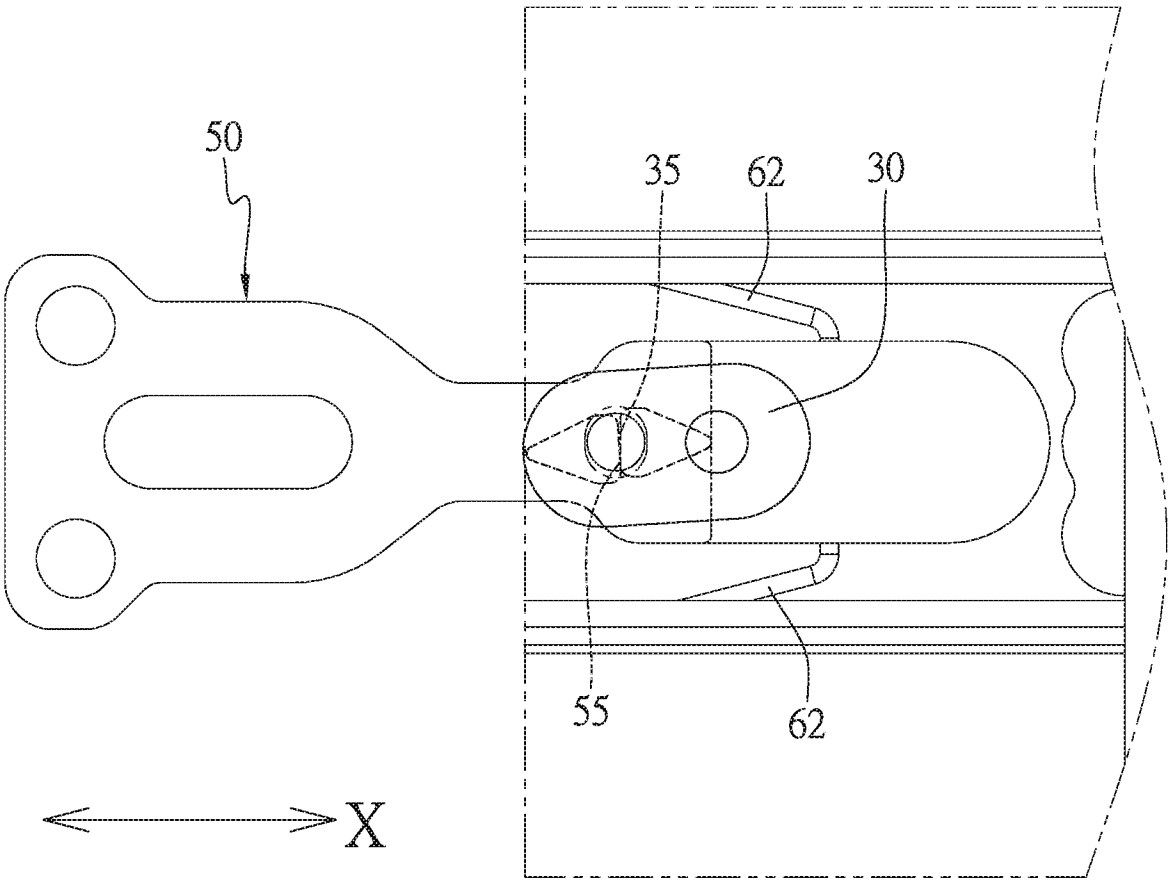
FIG. 8 is a side elevational view of the present invention in a locked state in accordance with a preferred embodiment.

Referring to FIG. 8, when in the locked state, the first dislocation block 38 passes over the second dislocation block 57, since the pull lever 50 is pushed by the two elastic arms 62 of the elastic member 60, when the second dislocation block 57 is no longer pushed by the first dislocation block 38, the pull lever 50 is pushed by the two elastic arms 62 to return to the middle of the two slide rail side portions 43, so that the first stop surface 35 abuts against the second stop surface 55 to achieve the effect of preventing the slide rail 40 from coining off.

Figure 9:
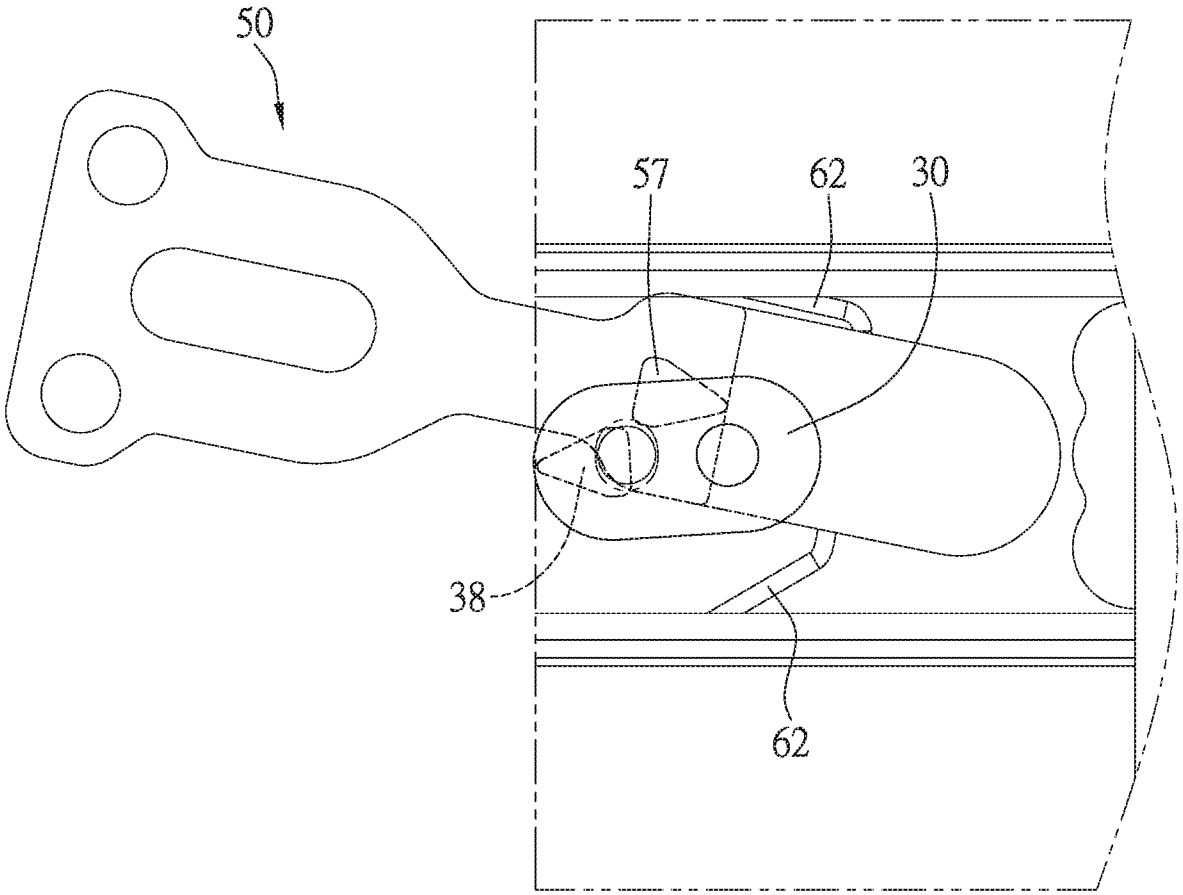
FIG. 9 is a side elevational view of the present invention in a slide-out state.

Referring to FIG. 9, when the user wants to slide out the slide rail 40, he/she can pull the pull lever 50, then the pull lever 50 pivots about the slide rail pivot hole 421 to make the first stop surface 35 misaligned with the second stop surface 55, so that the user can pull the slide rail 40 in the extending direction to make the slide rail slide out of the main rail 20.

Preferably, the pull lever 50 is further provided with an assembling hole 510. When the user installs two sets of drawer slides with two-way opening and closing structure on two opposite sides of a cabinet, a gripping lever (not shown) can be disposed between the two assembling holes 510 of the two sets of drawer slides, and the user can pull the pull lever 50 by the gripping lever.

Referring to FIG. 6, in this embodiment, the limiting portion 21 is an elongated hole 211 having opposite ends in the vertical direction Y. When the pivot block 30 rotates around the main rail pivot hole 231, the offset post 31 of the pivot block 30 abuts against one end of the elongated hole 211, thereby fixing the pivot block 30 while making the first guide tip 32 of the pivot block 30 misaligned with the second guide tip 52.

Figure 10:
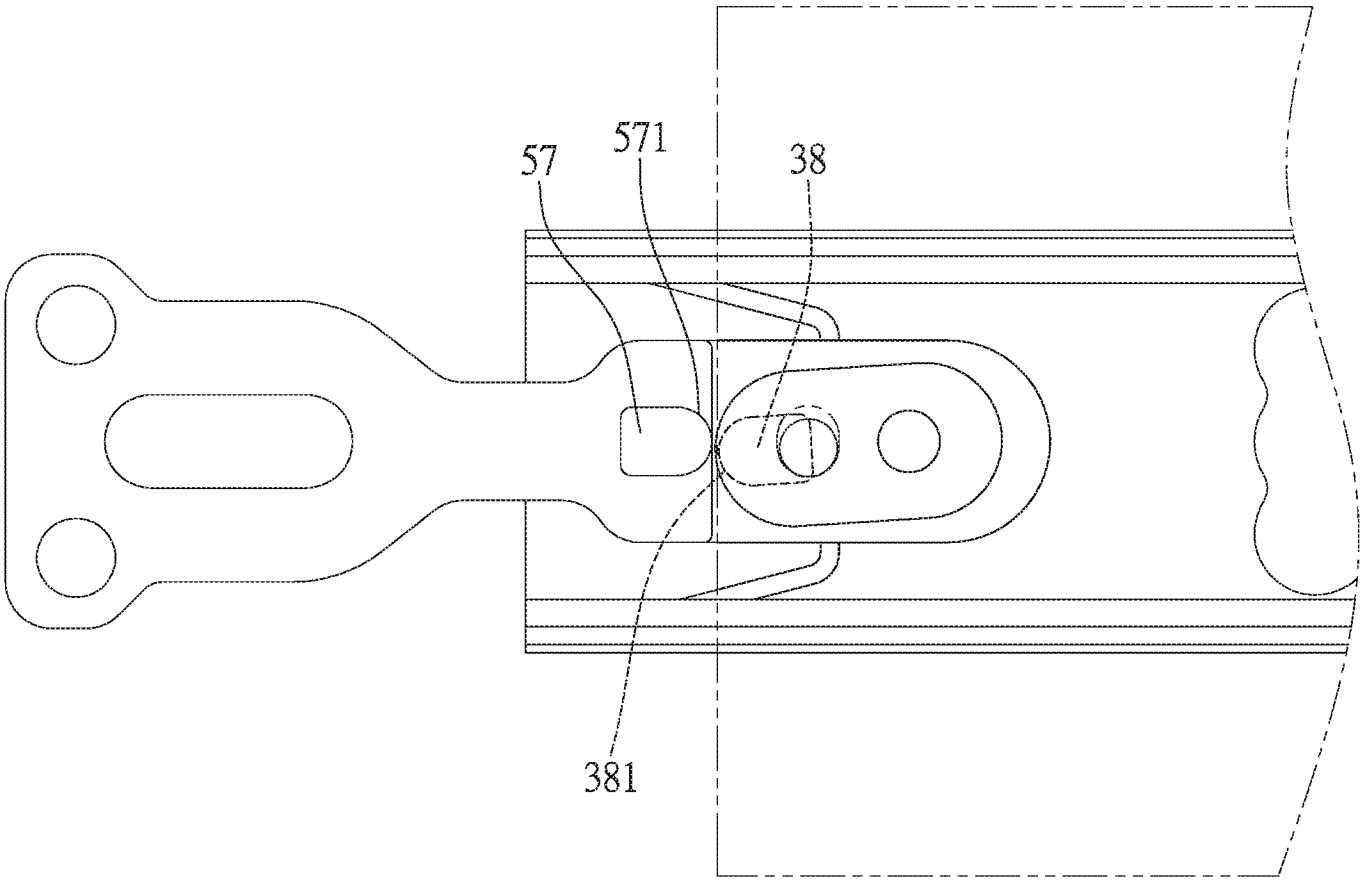
FIG. 10 is a side elevational view of the present invention in another preferred embodiment.

Referring to FIG. 10, in another embodiment, the first guide tip 32, the first connecting surface 33 and the second connecting surface 34 define a first curved surface 381, and the second guide tip 52, the first guide surface 53 and the second guide face 54 together define a second curved surface 571.

Figure 11:
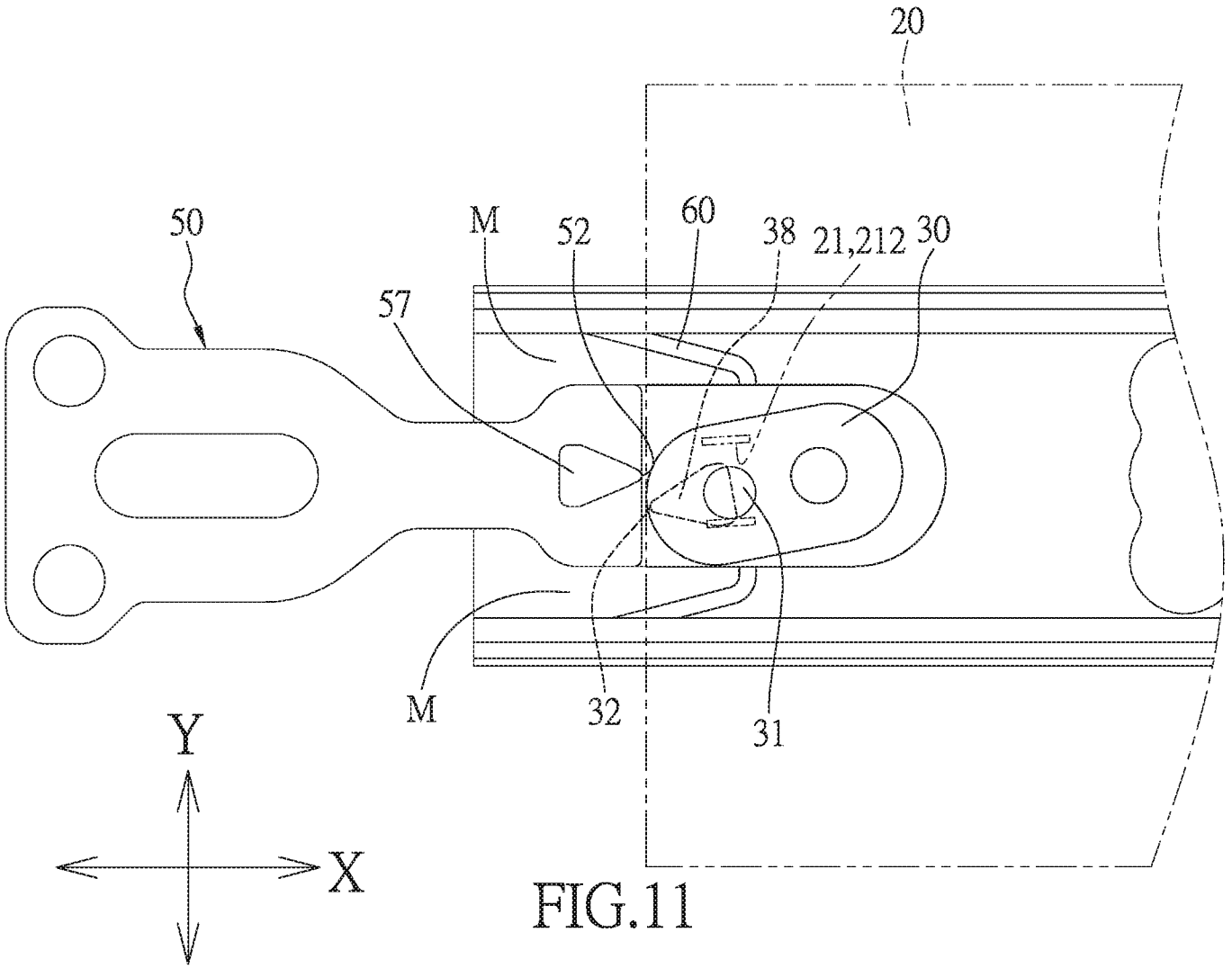
FIG. 11 is a side view of the last embodiment of the present invention.

Referring to FIG. 11, in the last embodiment, the limiting portion 21 has two protrusions 212 protruding from the main rail 20 along the vertical direction Y. When the pivot block 30 rotates around the main rail pivot hole 231, the offset post 31 of the pivot block 30 abuts against the one of the protrusions 212 to fix the pivot block 30, while the first guide tip 32 of the pivot block 30 is misaligned with the second guide tip 52.

In particular, when the user fix the main rail 20 on the left side of the cabinet, the pivot block 30 pivots around the main rail pivot hole 231, and the offset post 31 is abutted against the lower end of the limiting portion 21 because of gravity. When the user fix another main rail 20 on the right side of the cabinet, the pivot block 30 will pivot about the main rail pivot hole 231, and the offset post 31 is abutted against the lower end of the limiting portion 21 because of gravity.

Since the offset post 31 of the pivot block 30 can move in the limiting portion 21 along the vertical direction Y, two identical drawer slides with two-way opening and closing structure can be respectively installed on the left side and the right side of the cabinet, namely, two identical slide rails 40 can be applied to the two opposite sides of the drawer, which makes it easier to install the slide rail 40. More preferably, only one type of mold is needed during the manufacturing of the slide rails, thereby reducing the overall manufacturing cost.

While we have shown and described various embodiments in accordance with the present invention, it is clear to those skilled in the art that further embodiments may be made without departing from the scope of the present invention.

What is claimed is:

1. A drawer slide with a two-way opening and closing structure, comprising:

a main rail having a limiting portion disposed along a vertical direction and at one end of the main rail;

a pivot block having an offset post, a first guide tip, a first connecting surface adjacent to the first guide tip, a second connecting surface adjacent to the first guide tip, and a first stop surface;

a slide rail having two opposing side walls;

a pull lever having two opposite side surfaces, a second guide tip, a first guide surface adjacent to the second guide tip, a second guide surface adjacent to the first guide tip, and a second stop surface;

at least one elastic member;

wherein the pivot block is pivotally disposed on the main rail, the offset post is movably disposed at the limiting portion along the vertical direction, the first guide tip is located toward the end, the first stop surface is located away from the end, the slide rail is slidably disposed on the main rail along a displacement direction, the pull lever is pivotally provided on the slide rail and disposed between the two side walls, so that the two side surfaces face and are located a distance from the side walls, the at least one elastic member is disposed between the two side walls and the two side surfaces;

by such arrangements, the slide rail has a slide-out state, a slide-in state, and a locked state;

when in the slide-out state, the offset post is abutted against one end of the limiting portion, so that the first and second guide tips are opposite to each other in a misaligned manner;

when in the slide-in state, the first connecting surface is in contact with the first guide surface, or the second connecting surface is in contact with the second guide surface;

when in the locked state, the first stop surface abuts against the second stop surface.

2. The drawer slide with the two-way opening and closing structure as claimed in claim 1, wherein the first and second connecting surfaces each have one end connected to the first guide tip, and have another end connected to two ends of the first stop surface, respectively.

3. The drawer slide with the two-way opening and closing structure as claimed in claim 1, wherein the first guide tip, the first connecting surface and the second connecting surface define a first curved surface, and the second guide tip, the first guide surface and the second guide face together define a second curved surface.

4. The drawer slide with the two-way opening and closing structure as claimed in claim 1, wherein an extension rail is disposed between the main rail and the slide rail, and the main rail is coupled to the slide rail along the displacement direction through the extension rail.

5. The drawer slide with the two-way opening and closing structure as claimed in claim 1, wherein the pull lever is further provided with an assembling hole.

6. A drawer slide with a two-way opening and closing structure, comprising:

a main rail having a limiting portion disposed along a vertical direction and at one end of the main rail, wherein the limiting portion is an elongated hole having opposite ends in the vertical direction;

a pivot block having an offset post, a first guide tip, a first connecting surface adjacent to the first guide tip, a second connecting surface adjacent to the first guide tip, and a first stop surface;

a slide rail having two opposing side walls;

a pull lever having two opposite side surfaces, a second guide tip, a first guide surface adjacent to the second guide tip, a second guide surface adjacent to the first guide tip, and a second stop surface;

at least one elastic member;

wherein the pivot block is pivotally disposed in a main rail pivot hole of the main rail, when the pivot block rotates around the main rail pivot hole, the offset post of the pivot block abuts against one end of the elongated hole, thereby fixing the pivot block while making the first guide tip of the pivot block misaligned with the second guide tip, the first guide tip is located toward the end, the first stop surface is located away from the end, the slide rail is slidably disposed on the main rail along a displacement direction, the pull lever is pivotally provided on the slide rail and disposed between the two side walls, so that the two side surfaces face and are located a distance from the side walls, the at least one elastic member is disposed between the two side walls and the two side surfaces;

by such arrangements, the slide rail has a slide-out state, a slide-in state, and a locked state;

when in the slide-out state, the offset post is abutted against one end of the elongated hole, so that the first and second guide tips are opposite to each other in a misaligned manner;

when in the slide-in state, the first connecting surface is in contact with the first guide surface, or the second connecting surface is in contact with the second guide surface;

when in the locked state, the first stop surface abuts against the second stop surface.

7. The drawer slide with the two-way opening and closing structure as claimed in claim 6, wherein the first and second connecting surfaces each have one end connected to the first guide tip, and have another end connected to two ends of the first stop surface, respectively.

8. The drawer slide with the two-way opening and closing structure as claimed in claim 6, wherein the first guide tip, the first connecting surface and the second connecting surface define a first curved surface, and the second guide tip, the first guide surface and the second guide face together define a second curved surface.

9. The drawer slide with the two-way opening and closing structure as claimed in claim 6, wherein an extension rail is disposed between the main rail and the slide rail, and the main rail is coupled to the slide rail along the displacement direction through the extension rail.

10. The drawer slide with the two-way opening and closing structure as claimed in claim 6, wherein the pull lever is further provided with an assembling hole.

11. A drawer slide with a two-way opening and closing structure, comprising:

a main rail having a limiting portion disposed along a vertical direction and at one end of the main rail, wherein the limiting portion has two protrusions protruding from the main rail along the vertical direction;

a pivot block having an offset post, a first guide tip, a first connecting surface adjacent to the first guide tip, a second connecting surface adjacent to the first guide tip, and a first stop surface;

a slide rail having two opposing side walls;

a pull lever having two opposite side surfaces, a second guide tip, a first guide surface adjacent to the second guide tip, a second guide surface adjacent to the first guide tip, and a second stop surface;

at least one elastic member;

wherein the pivot block is pivotally disposed in a main rail pivot hole of the main rail, when the pivot block rotates around the main rail pivot hole, the offset post of the pivot block abuts against one of the protrusions, thereby fixing the pivot block while making the first guide tip of the pivot block misaligned with the second guide tip, the first guide tip is located toward the end, the first stop surface is located away from the end, the slide rail is slidably disposed on the main rail along the displacement direction, the pull lever is pivotally provided on the slide rail and disposed between the two side walls, so that the two side surfaces face and are located a distance from the side walls, the at least one elastic member is disposed between the two side walls and the two side surfaces;

by such arrangements, the slide rail has a slide-out state, a slide-in state, and a locked state;

when in the slide-out state, the offset post is abutted against one of the protrusions, so that the first and second guide tips are opposite to each other in a misaligned manner;

when in the slide-in state, the first connecting surface is in contact with the first guide surface, or the second connecting surface is in contact with the second guide surface;

when in the locked state, the first stop surface abuts against the second stop surface.

12. The drawer slide with the two-way opening and closing structure as claimed in claim 11, wherein the first and second connecting surfaces each have one end connected to the first guide tip, and have another end connected to two ends of the first stop surface, respectively.

13. The drawer slide with the two-way opening and closing structure as claimed in claim 11, wherein the first guide tip, the first connecting surface and the second connecting surface define a first curved surface, and the second guide tip, the first guide surface and the second guide face together define a second curved surface.

14. The drawer slide with the two-way opening and closing structure as claimed in claim 11, wherein an extension rail is disposed between the main rail and the slide rail, and the main rail is coupled to the slide rail along the displacement direction through the extension rail.

15. The drawer slide with the two-way opening and closing structure as claimed in claim 11, wherein the pull lever is further provided with an assembling hole.

* * * * *